US007874103B2

(12) United States Patent
Yates

(10) Patent No.: US 7,874,103 B2
(45) Date of Patent: Jan. 25, 2011

(54) GATE ASSEMBLY

(75) Inventor: Adam Yates, Harrogate (GB)

(73) Assignee: Lindam Limited (GB)

( * ) Notice: Subject to any disclaimer, the term of this patent is extended or adjusted under 35 U.S.C. 154(b) by 77 days.

(21) Appl. No.: 12/170,713

(22) Filed: Jul. 10, 2008

(65) Prior Publication Data

US 2009/0013606 A1 Jan. 15, 2009

(30) Foreign Application Priority Data

Jul. 12, 2007 (GB) ..... 0713586.6

(51) Int. Cl.
*E06B 3/68* (2006.01)

(52) U.S. Cl. ..... 49/57; 49/226; 49/465

(58) Field of Classification Search ..... 49/50, 49/56, 57, 226, 232, 233, 254, 257, 258, 49/394, 463, 465, 506; 160/210, 211
See application file for complete search history.

(56) References Cited

U.S. PATENT DOCUMENTS 3,788,689 A * 1/1974 Lloyd ..... 292/304
4,070,074 A * 1/1978 Rohme ..... 312/245
4,294,040 A * 10/1981 Crotti ..... 49/254
4,679,353 A * 7/1987 Langenbach et al. ..... 49/257
4,993,187 A * 2/1991 Schweiss et al. ..... 49/56
5,056,262 A * 10/1991 Schweiss et al. ..... 49/56
5,953,860 A * 9/1999 Morgan et al. ..... 49/257
6,347,483 B1 * 2/2002 Andersen ..... 49/57
6,499,254 B2 * 12/2002 Rossman et al. ..... 49/55
7,318,298 B2 * 1/2008 Marsden et al. ..... 49/57
7,540,046 B1 * 6/2009 Lai ..... 5/100

* cited by examiner

*Primary Examiner*—Jerry Redman
(74) *Attorney, Agent, or Firm*—McKee, Voorhees & Sease, P.L.C.

(57) ABSTRACT

A gate assembly is provided for positioning in an opening through which selective entry is required. The gate assembly includes barrier means mountable directly or indirectly to one or more surrounding surfaces defining the opening. Hinge means are provided to allow the barrier means to be movable relative to the surrounding surfaces in use between a closed position, wherein the opening is closed, to an open position, wherein the opening is open. The hinge means include a hinge pin movably mounted in a channel or recess. The channel or recess receiving the hinge pin in use has a taper which narrows from an opening of said channel or recess through which said hinge pin is located in use towards a base or opposite end of said recess or channel.

17 Claims, 4 Drawing Sheets

GATE ASSEMBLY

FIELD OF THE INVENTION

This invention relates to a gate assembly, and particularly but not necessarily exclusively to a gate assembly in the form of a child safety barrier or gate.

BACKGROUND OF THE INVENTION

It is known to provide child safety barriers which are removably located in an opening of a doorway, stairway and/or the like to prevent a child or animal from going through the opening when the barrier is fitted and in a closed position. The barriers typically include a frame which is fitted to the side walls defining the opening, and a gate or barrier which is hingedly or slidably mounted to the frame for movement between open and closed positions.

In order to ensure that the child safety barriers are not accidentally opened by a young child, some conventional gates require a user to exert a substantially vertical lifting force to an upper portion of the gate prior to opening the gate. The position of where the lifting force is to be exerted on the gate is considered out of reach for a young child, and the required lifting force sufficiently large to prevent a young child from opening the gate. However, a problem with such gates is that a user can accidentally apply a twisting or horizontal force in addition to the lifting force when opening the gate and this can damage the hinges of the gate since the hinges are not designed to undergo such angular movement. As such, the gate may be prevented from opening and closing smoothly over time due to hinge damage, and any latch mechanism provided on the gate may become out of alignment with the latch retaining means to prevent correct latching of the gate in a closed position.

An example of a known child safety barrier allowing a degree of movement to take place in a plane parallel to the gate, as well as vertically, is disclosed in GB2268210. A lower hinge on the gate is mounted in a horizontal slot which allows for some movement of the gate in a plane parallel to the gate. However, the upper hinge on the gate may still sustain damage over time despite a degree of horizontal movement being allowed in the lower hinge.

BRIEF SUMMARY OF THE INVENTION

It is therefore an aim of the present invention to provide an improved gate assembly.

It is a further aim of the present invention to provide a method of using a gate assembly.

According to a first aspect of the present invention there is provided a gate assembly for positioning in an opening through which selective entry is required, said gate assembly including barrier means mountable directly or indirectly to one or more surrounding surfaces defining said opening and hinge means to allow said barrier means to be movable relative to said surrounding surfaces in use between a closed position, wherein the opening is closed, to an open position, wherein the opening is open, said hinge means including a hinge pin movably mounted in a channel or recess, and wherein the channel or recess receiving the hinge pin in use has a taper which narrows from an opening of said channel or recess through which said hinge pin is located in use towards a base or opposite end of said recess or channel.

With the barrier means in the closed position, entry through the opening is substantially prevented, particularly to a small child or animal, such as a dog. With the barrier means in the open position, entry through the opening is allowable.

The provision of the tapered hinge pin recess or channel along the length thereof allows the hinge pin to undergo angular motion in use (i.e. motion through an acute angle about a substantially horizontal axis and typically in the same plane as the barrier means). Thus, the hinge means is typically capable of undergoing normal rotational movement about a substantially vertical axis or longitudinal axis of the hinge pin and, in accordance with the present invention, the hinge means can also undergo angular or tilting movement relative to the vertical or horizontal axis (i.e. rotational movement about a substantially horizontal axis or in the plane of the barrier means). The provision of movement in a number of directions accommodates any angular strain that is placed on the hinge, thus preventing damage to the hinge in use.

The hinge pin is typically associated with one of the surrounding surface (directly or indirectly) or barrier means (directly or indirectly) and the channel or recess is typically associated with the other of the surrounding surface (directly or indirectly) or barrier means (directly or indirectly).

Preferably the gate assembly has at least upper and lower hinge means and the tapered channel or recess is associated with at least the lower hinge means. (The upper or top hinge means is typically above the lower or base hinge means and preferably in substantially vertical alignment). In one embodiment a tapered channel or recess can be associated with both the upper and lower hinge means. In a preferred embodiment the tapered channel or recess is associated only with the lower or base hinge means.

Preferably resilient biasing means are provided with or associated with the hinge means and further preferably the with upper hinge means. Further preferably said resilient biasing means are arranged so as to bias a part of the barrier means, and preferably an upper part of the barrier means, in a substantially horizontal direction or in a direction substantially parallel to the plane or the barrier means or in the same plane as the barrier means.

Preferably the hinge means are provided on a first side of the barrier means and latch means are provided on a second and preferably opposite side of the barrier means.

The barrier means can be hinged via the hinge means to frame or housing means which are attached to at least one of the surrounding surface(s) defining the opening. Alternatively the barrier means can be hinged via the hinge means directly to at least one of the surrounding surface(s). In a further alternative positioning means are associated with the housing or frame means to allow the same to be engaged to the surrounding surfaces defining said opening.

According to a second aspect of the present invention there is provided a gate assembly for positioning in a suitable opening through which selective entry is required, the gate assembly including barrier means mountable directly or indirectly to one or more surrounding surfaces defining said opening via upper and lower hinge means and movable relative to said surfaces between a closed position, wherein the opening is closed, to an open position, wherein the opening is open, characterised in that the lower hinge means is capable of undergoing movement substantially in the plane of the barrier means and the upper hinge means is resiliently biased substantially horizontally or substantially in the plane of the barrier.

According to a further aspect of the present invention there is provided a gate assembly for positioning in a suitable opening through which selective entry is required, the gate assembly including barrier means mounted directly or indirectly to one or more surrounding surfaces defining said opening via upper and lower hinge means and movable relative to said surfaces between a closed position, wherein the opening is closed, to an open position, wherein the opening is open, characterised in that both the upper and lower hinge means can undergo substantially horizontal movement or movement substantially in the plane of the barrier means.

Preferably the resilient biasing means biases the hinge means away from the surface with which the hinge means is adjacent to in use. Further preferably the biasing means biases the upper hinge means away from the surrounding surface with which the upper hinge means is adjacent to in use.

Preferably the barrier means includes at least one gate panel and further preferably at least two gate panels. Adjustment means can be associated with at least one of the two gate panels. This allows the at least two gate panels to be adjustable relative to each other to adjust the width of the barrier means to fit different openings in which the gate assembly is located in use. In one embodiment the gate panels are slidably mounted to each other but any adjustment mechanism can be used.

In one embodiment a latch mechanism is provided on the gate assembly. The latch mechanism is typically provided on the side of the gate opposite to the hinge means.

Preferably the latch mechanism includes a latch element associated with one of the barrier means or surrounding surface which can be seated in a keep housing associated with the other of the barrier means or surrounding surface with the barrier means in the closed position. The latch element is preferably removed from the keep housing by lifting the latch element from an opening of a recess defined in the keep housing. This lifting action is preferably in a substantially vertical direction. Once the latch element is removed from the keep housing, the latch element can typically be moved through a substantially horizontal plane (i.e. about a vertical axis or the axis of the hinge means).

Preferably a locking element is movably mounted on or adjacent the recess opening of the keep housing. The locking element can be moved between an unlocked position, wherein the locking element is a spaced distance from the recess and the latch element can be removed from the keep housing, to a locked position, wherein the locking element is adjacent the recess opening and the latch element is substantially prevented from being removed from the keep housing.

Preferably the locking element is resiliently biased to the locked position.

Preferably the locking element is pivotably mounted and can be moved in either one of two possible or opposite directions from the locked position to the unlocked position. This allows the locking element to lock and/or unlock irrespective of the direction in which the barrier means is opened (i.e. in a forwardly or rearwardly direction). Further preferably the locking element typically pivots about a substantially horizontal axis.

In one embodiment at least an upper (or top) and a lower (or base) latch mechanism is provided. Preferably the upper latch mechanism includes the locking element, although a locking element could be provided on both latch mechanisms if required. Preferably the lower latch mechanism includes a latch element movable with respect to a keep housing. The upper and lower latch mechanisms are preferably substantially vertically aligned.

Further preferably the upper and lower latch mechanisms are in substantial horizontal alignment with the upper and lower hinge means.

In one embodiment the upper or top latch mechanism and/or hinge means is associated with an upper or top frame member of the barrier means. The lower or base latch mechanism and/or hinge means is associated with a lower or base frame member of the barrier means.

According to a further aspect of the present invention there is provided a method of using a gate assembly.

In one embodiment said gate assembly is for positioning in an opening through which selective entry is required in use, said gate assembly including barrier means and hinge means, said method including the steps of mounting said barrier means directly or indirectly to one or more surrounding surfaces defining said opening, arranging said hinge means to allow said barrier means to be movable relative to said surrounding surfaces in use between a closed position, wherein the opening is closed, to an open position, wherein the opening is open, said hinge means including a hinge pin movably mounted in a channel or recess, and wherein the channel or recess receiving the hinge pin in use has a taper which narrows from an opening of said channel or recess through which said hinge pin is located in use towards a base or opposite end of said recess or channel, thereby allowing said barrier means to undergo angular motion relative to a substantially vertical axis during movement between said closed and open positions.

An embodiment of the present invention will now be described with reference to the accompanying figures, wherein:

DETAILED DESCRIPTION OF PREFERRED EMBODIMENTS

Figure 1:
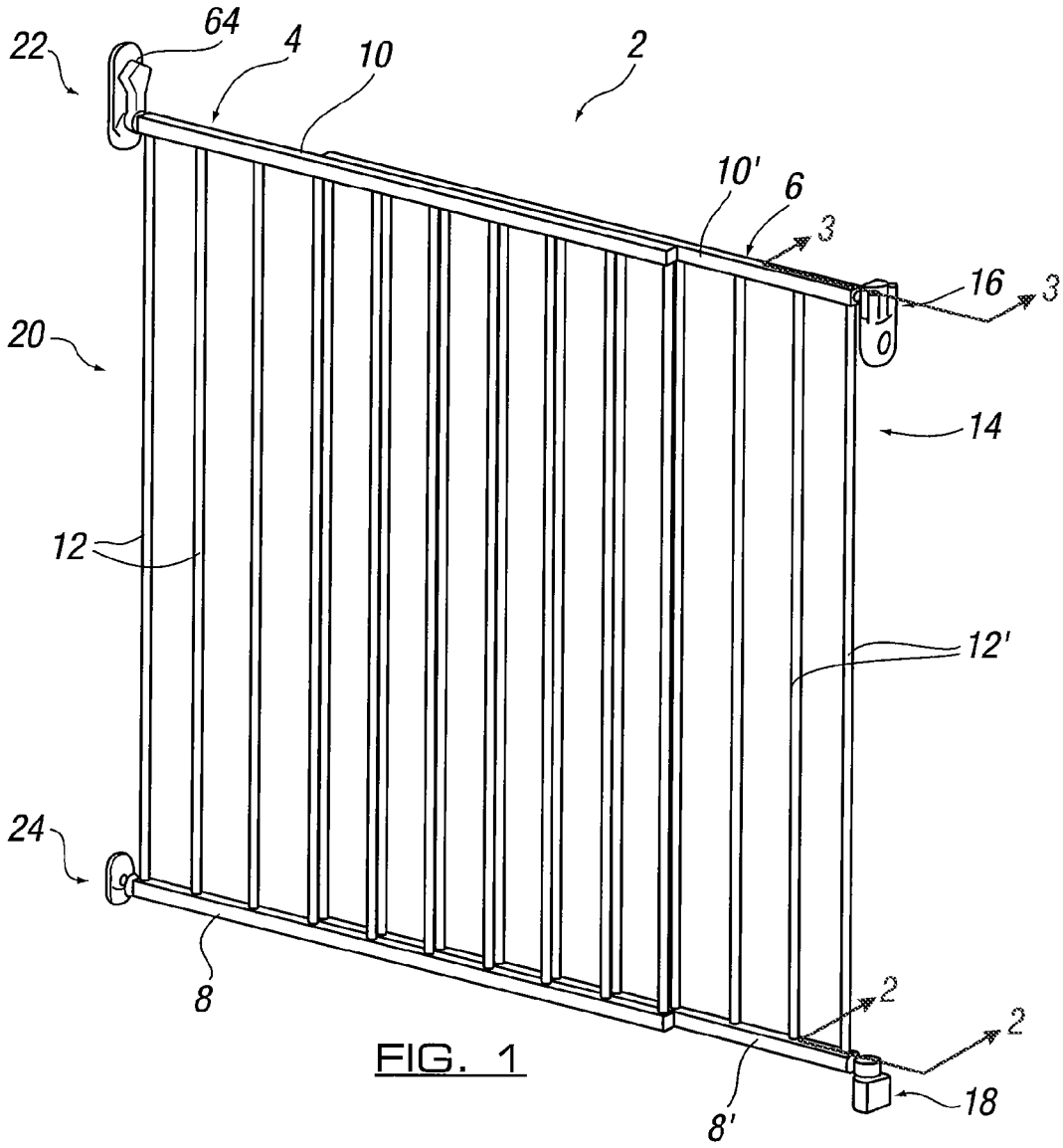
FIG. 1 is a perspective view of a gate assembly according to one embodiment of the present invention.

Referring firstly to FIG. 1, there is illustrated a gate assembly 2 including barrier means in the form of two gate panels 4, 6. The gate panels 4, 6 are slidably mounted to each other to allow adjustment of the width of the barrier means to allow the gate assembly to fit in different sized openings through which selective entry is required. For example, the gate assembly can be used as a child safety barrier to prevent young children or small animals from passing through the opening without adult supervision. It will be appreciated that the gate assembly of the present invention could include a single gate panel or three or more gate panels. The adjustment mechanism can be any suitable sliding or other adjustment mechanism.

Each gate panel 4, 6 includes a base member 8, 8' and a top member 10, 10' respectively, with a plurality of upright strut members 12, 12' located at spaced apart intervals between the top and base members.

At one side 14 of gate panel 6 there is provided upper and lower hinges 16, 18 respectively. At the opposite side 20 on gate panel 4 there are associated upper and lower latch mechanisms 22, 24 respectively. The upper and lower hinge means are typically substantially vertically and horizontally aligned with the upper and lower mechanisms respectively.

Figure 2:
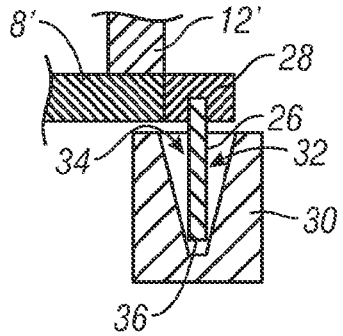
FIG. 2 is a cross sectional view taken through lower hinge means of the gate assembly in FIG. 1.

With reference to FIG. 2, lower hinge 18 includes a hinge pin 26 located at end 28 of base member 8'. Hinge pin 26 extends downwardly in a direction substantially opposite to upright struts 12' (or substantially perpendicularly to base member 8') and is mountable in a recess 32 defined in housing 30. The recess 32 is tapered and said taper narrows from top opening 34 to a base 36. The tapered recess allows movement of hinge pin 26 relative thereto and substantially in the plane of the gate panel (i.e. hinge pin 26 and gate panels 4, 6 can undergo tilting or angular movement about a substantially horizontal axis 88). Housing 30 can be attached directly to a wall surface which at least partially defines the opening in which the gate assembly is located or can be attached to or form part of a frame which is fitted to the wall surface defining the opening. In one embodiment the recess is in the form of an inverse truncated cone.

Figure 3A:
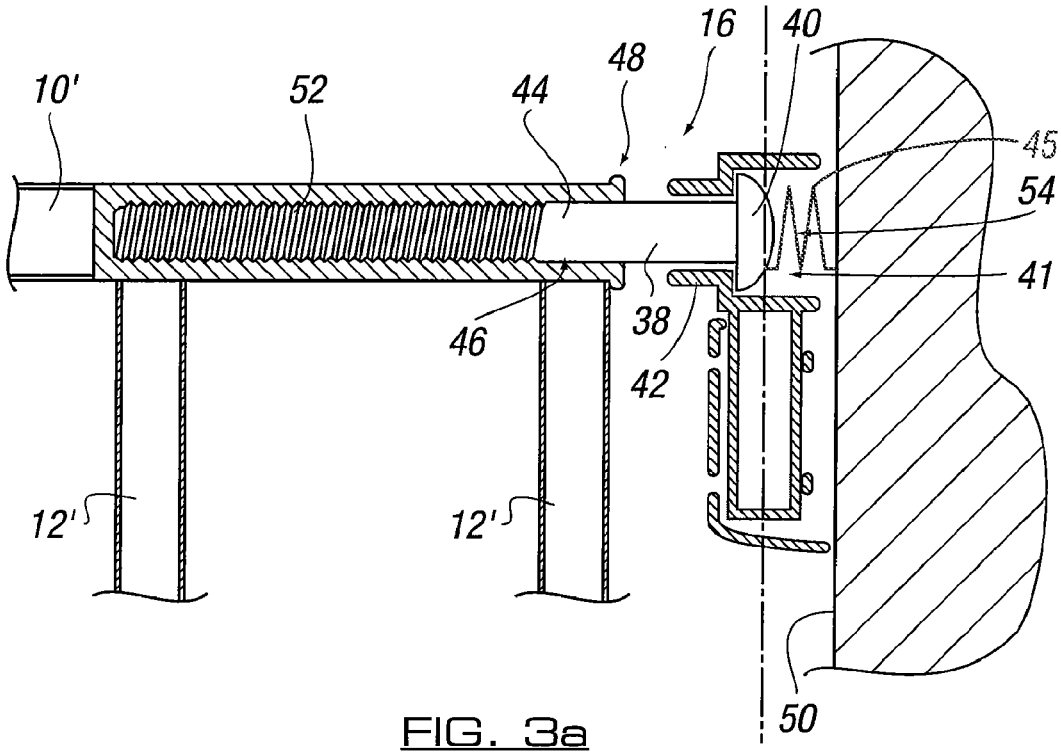
FIGS. 3*a* and 3*b* are cross sectional views taken through upper hinge means of the gate assembly in FIG. 1 when the gate is in a closed position and an open position respectively.
Figure 3B:
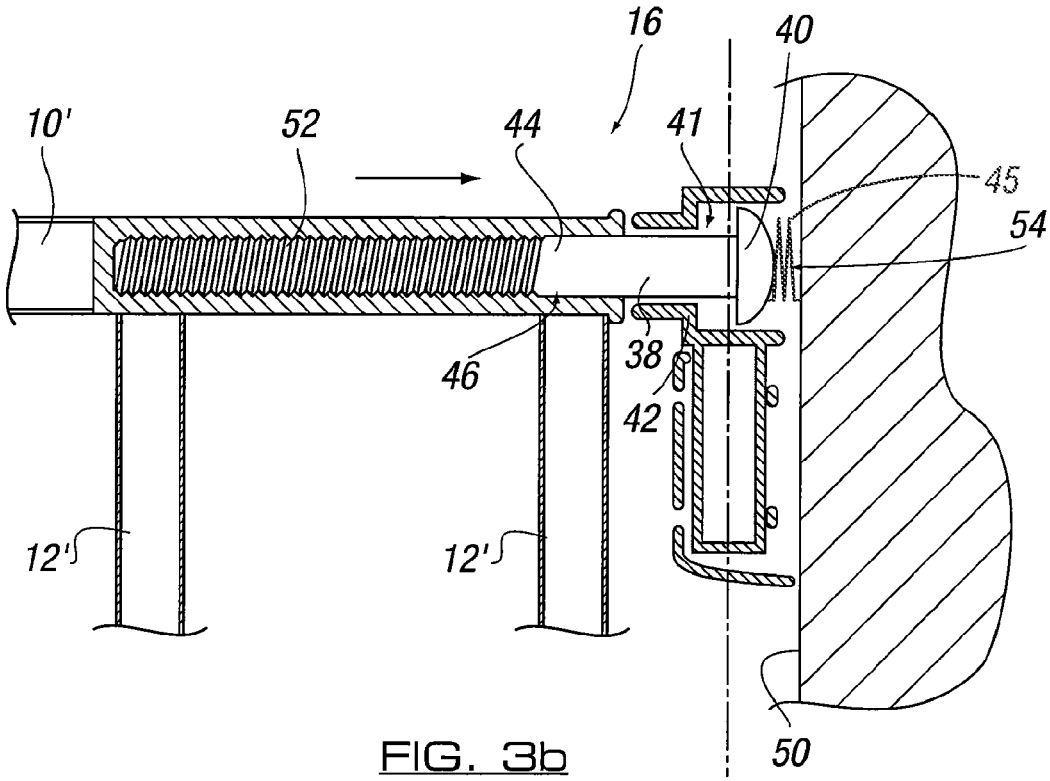

With reference to FIGS. 3*a* and 3*b*, upper hinge 16 includes a bolt 38 which has a head end 40 slidably movable in a channel 41 defined in a housing 42 and an opposite end 44 slidably mounted in a channel 46 defined at end 48 of top member 10'. Housing 42 is mounted to a wall surface 50 partially defining the opening in which the gate assembly is located. Resilient biasing means in the form of a spring 45 can be located in position 52 at end 44 of bolt 38 and/or in position 54 located in channel 41 between wall 50 and head end 40 of bolt 38. The resilient biasing means allows bolt 38 and thus top member 10' of the gate panel to move substantially horizontally and/or in plane substantially parallel to that of the gate panel when the lower hinge undergoes tilting or angular movement. This prevents damage to the hinge 16 on lifting and tilting of the gate about lower hinge 18. Both hinges 16, 18 can also rotate about a substantially vertical axis as with a conventional hinge.

Figure 4A:
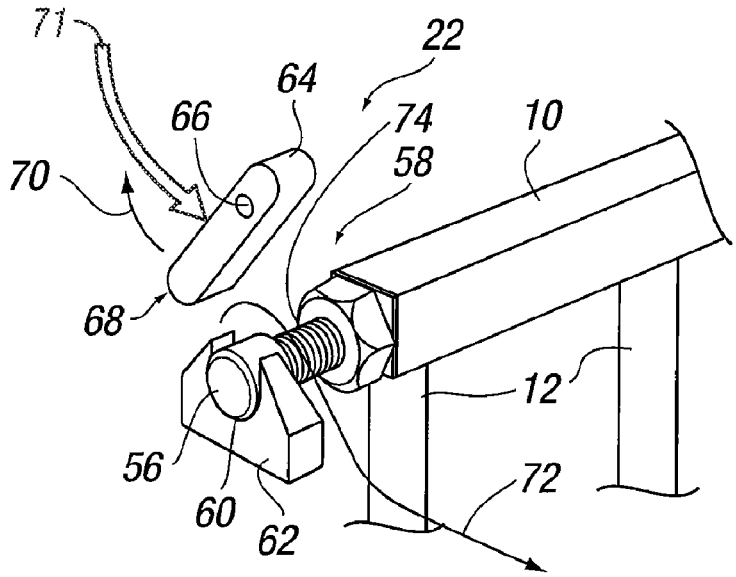
FIGS. 4*a* and 4*b* show upper and lower latch mechanisms respectively.
Figure 4B:
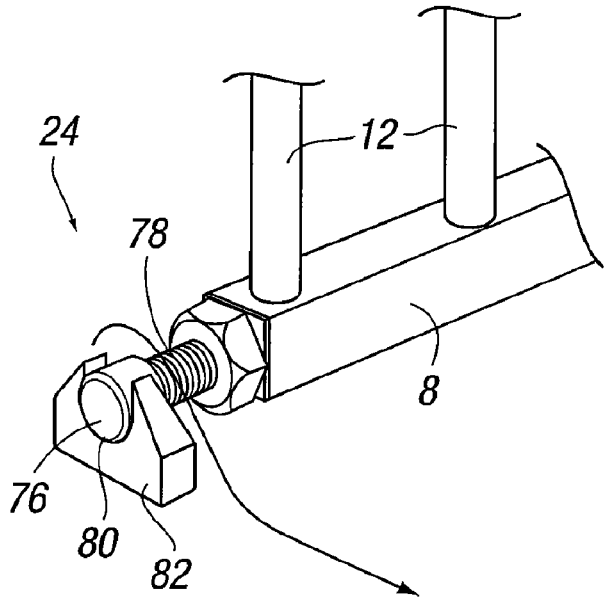

With reference to FIGS. 4*a* and 4*b*, there is illustrated an upper latch mechanism 22 and a lower latch mechanism 24 respectively provided on side 20 of gate panel 4.

Upper latch mechanism 22 includes a latch element 56 provided on end 58 of top member 10, which is movable relative to a complementary shaped recess 60 defined in a keeper housing 62. Housing 62 is typically fitted to a side wall defining the opening in which the gate assembly is located in use. A locking element 64 is associated on or above keeper housing 62 and is pivotably mounted about a pivot point 66 for movement in a forwardly or rearwardly direction between locked and unlocked positions. In the locked position, the latch element 56 is seated in recess 60 and the free end 68 of locking element 64 is substantially vertically aligned adjacent to and above the opening of recess 60, thereby preventing removal of latch element 56 from recess 60. In the unlocked position, locking element 64 is pivoted a spaced distance apart from the opening of recess 60, as shown by arrow 70 in FIG. 4*a*, thereby allowing latch element 56 to be lifted from recess 60 and swung to an open position, as shown by arrow 72 in FIG. 4*a*. Locking element 64 is resiliently biased (as indicated by arrow 71) to the locked position and said locking element can typically be operated by a user using their fingers on a single hand. The latch element 56 is typically provided with a screw threaded portion 74 to allow the length of the same to be adjusted relative to top member 10, thereby allowing the gate assembly to be used in openings of different widths.

The lower latch mechanism 24 is substantially vertically aligned with the upper latch mechanism 22 and includes a latch element 76 of a similar type to latch element 56. Thus, latch element 76 has a screw threaded portion 78 to allow the length of the same to be adjusted relative to base member 8. The latch element 76 sits in a recess 80 defined in a keeper housing 82 fitted to the side wall defining the opening. When the gate is lifted to release upper latch element 56 from recess 60, lower latch element 76 is also lifted from recess 80, thereby allowing the gate to be opened. When latching the gate, the above described movements are carried out in reverse.

Figure 5A:
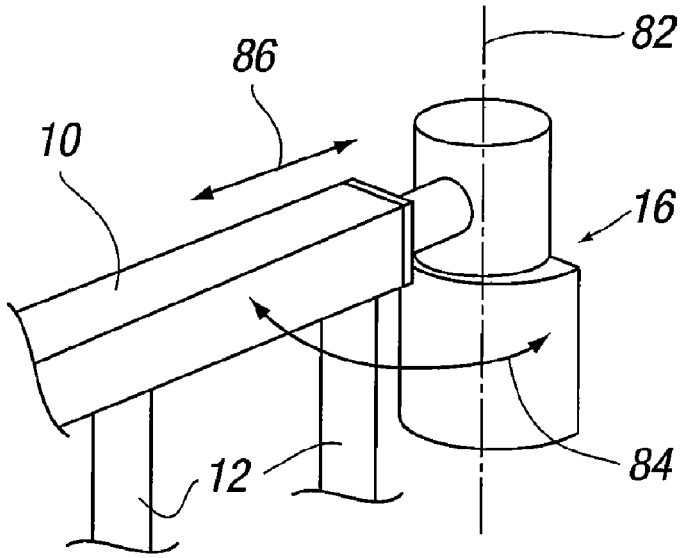
FIGS. 5*a* and 5*b* show possible movements of the upper and lower hinge means respectively.

FIG. 5*a* illustrates how the upper hinge 16 can be pivotably movable about a substantially vertical axis 82 to allow the gate panels to be moved between opened and closed positions, as shown by arrow 84; and also substantially horizontally or in a plane substantially parallel to that of the gate panels to allow the lower hinge to be tilted or undergo angular motion without damage to the upper hinge, as shown by arrow 86.

Figure 5B:
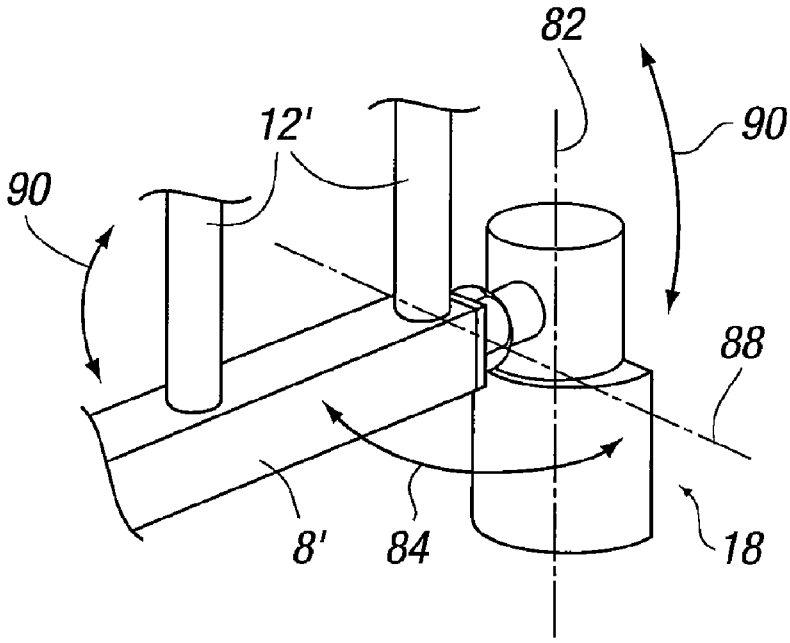

FIG. 5*b* illustrates how the lower hinge 18 can be pivotably movable about a substantially vertical axis 82, as shown by arrow 84; and also substantially angularly within the plane of the door panel about a substantially horizontal axis 88, as shown by arrows 90.

In order to dismantle the gate to remove the gate assembly from the opening in which it is located in use, the hinge pins are simply lifted and removed from the accommodating channels. When fitting the gate, the hinge pins can be snap fitted or simple placed back into the channels.

The gate assembly can be formed in any suitable size, shape and/or design and can be made of any or any combination of materials, such as wood, plastic, metal, fabric and/or the like.

The invention claimed is:

1. A gate assembly for positioning in an opening through which selective entry is required, said gate assembly including barrier means mountable to at least one surrounding surface defining said opening and hinge means to allow said barrier means to be movable relative to said surrounding surface in use between a closed position, wherein the opening is closed, to an open position, wherein the opening is open, said hinge means including a hinge pin movably mounted in a recess, and wherein the recess receiving the hinge pin in use has a taper which narrows from an upper opening of said recess through which said hinge pin is located in use towards a lower base of said recess.

2. A gate assembly according to claim 1 wherein the gate assembly has at least upper and lower hinge means and the tapered recess is associated with at least the lower hinge means.

3. A gate assembly according to claim 2 wherein resilient biasing means are associated with the hinge means and arranged so as to bias the hinge means away from the surrounding surface with which the hinge means is adjacent to in use and in a substantially horizontal direction.

4. A gate assembly according to claim 3 wherein the resilient biasing means are associated with the upper hinge means.

5. A gate assembly according to claim 1 wherein the barrier means includes at least two gate panels and adjustment means are provided on one or more of said gate panels to allow adjustment of a width of the barrier means.

6. A gate assembly according to claim 5 wherein the at least one of the gate panels is slidable relative to another gate panel.

7. A gate assembly according to claim 1 wherein the hinge means are provided on a first side of the barrier means and latch means are provided on a second side of the barrier means opposite from the first side.

8. A gate assembly according to claim 7 wherein the latch means includes a latch element associated with one of the barrier means which is seated in a keep housing associated with the surrounding surface when the barrier means is in a closed position.

9. A gate assembly according to claim 8 wherein the latch element is removed from the keep housing by lifting the latch element from an opening of a recess defined in the keep housing.

10. A gate assembly according to claim 9 wherein a locking element is movably mounted adjacent the recess opening of the keep housing for movement between an unlocked position, wherein the locking element is a spaced distance apart from the recess and the latch element can be removed from the keep housing, to a locked position, wherein the locking element is adjacent the recess opening and the latch element is substantially prevented from being removed from the keep housing.

11. A gate assembly according to claim 10 wherein the locking element is resiliently biased to the locked position.

12. A gate assembly according to claim 10 wherein the locking element is pivotably mounted and can be pivoted in opposite directions between the locked and unlocked positions.

13. A gate assembly according to claim 7 wherein upper and lower latch means are associated with the barrier means.

14. A gate assembly according to claim 1 wherein the gate assembly forms a child safety gate.

15. A gate assembly according to claim 1, wherein the recess is in the form of an inverse truncated cone.

16. A gate assembly according to claim 1, wherein the hinge pin in use within the recess can rotate about a vertical axis and can tilt about a horizontal axis.

17. A method of using a gate assembly, said gate assembly for positioning in an opening through which selective entry is required in use, said gate assembly including barrier means and hinge means, said method including the steps of mounting said barrier means to at least one surrounding surface defining said opening, arranging said hinge means to allow said barrier means to be movable relative to said surrounding surface in use between a closed position, wherein the opening is closed, and an open position, wherein the opening is open, said hinge means including a hinge pin movably mounted in a recess, and wherein the recess receiving the hinge pin in use has a taper which narrows from an upper opening of said recess through which said hinge pin is located in use towards a lower base of said recess, thereby allowing said barrier means to undergo angular rotation relative to a substantially horizontal axis during movement between said closed and open positions.

* * * * *